US007211217B2

(12) United States Patent
Hinzpeter et al.

(10) Patent No.: US 7,211,217 B2
(45) Date of Patent: May 1, 2007

(54) PROCESS FOR THE MANUFACTURE OF COMPACTS IN A POWDER PRESS

(75) Inventors: Jurgen Hinzpeter, Schwarzenbek (DE); Ulrich Zeuschner, Schwarzenbek (DE); Ingo Schmidt, Schwarzenbek (DE); Thomas Pannewitz, Schwarzenbek (DE); Udo Baltruschat, Hamburg (DE); Thorsten Ehrich, Hamburg (DE); Ulf Hauschild, Schwarzenbek (DE)

(73) Assignee: Fette GmbH, Schwarzenbek (DE)

( * ) Notice: Subject to any disclaimer, the term of this patent is extended or adjusted under 35 U.S.C. 154(b) by 134 days.

(21) Appl. No.: 10/225,747

(22) Filed: Aug. 22, 2002

(65) Prior Publication Data

US 2003/0049147 A1 Mar. 13, 2003

(30) Foreign Application Priority Data

Aug. 31, 2001 (DE) ..... 101 42 772

(51) Int. Cl.
*B22F 1/00* (2006.01)
*B22F 1/02* (2006.01)

(52) U.S. Cl. ..... 419/1; 419/38

(58) Field of Classification Search ..... 425/78; 419/38, 1

See application file for complete search history.

(56) References Cited

U.S. PATENT DOCUMENTS 3,640,654 A * 2/1972 Smith ..... 425/78
3,687,586 A * 8/1972 Hara et al. ..... 425/78
3,826,599 A * 7/1974 DeSantis et al. ..... 425/78
4,260,346 A * 4/1981 Anderson et al. ..... 425/78
4,443,171 A * 4/1984 Dixon ..... 425/78
4,946,634 A * 8/1990 Shaner ..... 264/40.5

(Continued)

FOREIGN PATENT DOCUMENTS

DE 40 09 608 A1 11/1990

(Continued)

OTHER PUBLICATIONS

ASM Handbook, vol. 7, Powder Metallurgy, 1984, pp. 322-338.*

*Primary Examiner*—Roy King
*Assistant Examiner*—Christopher Kessler
(74) *Attorney, Agent, or Firm*—Vidas, Arrett & Steinkraus, P.A.

(57) ABSTRACT

A process for the manufacture of compacts, particularly cemented-carbide cutting blades, by compressing metallic powder and subsequently sintering the compacts wherein the compacts are formed in a powder press having a die-plate, an upper ram and at least one lower ram which are associated with a die-bore and are adapted to be actuated by a hydraulic press cylinder with the rams having associated thereto force-measuring devices and path-measuring devices to measure the compression forces during the ram feed motion up to the final positions, wherein the value of the energy to be applied by the upper ram is stored for a compact of predetermined geometry and dimensions and a predetermined material, that the overall energy to be applied by the upper and lower rams is further stored as a second value, that the feed motion of the upper ram is completed when the energy applied by the ram has reached the predetermined first value and the feed motion of the lower ram is effected depending on the application of the residual energy and is completed when the overall energy has reached the predetermined second value.

9 Claims, 2 Drawing Sheets

U.S. PATENT DOCUMENTS 5,326,242 A * 7/1994 Katagiri et al. ..... 425/78
5,379,688 A * 1/1995 Ishii ..... 100/35
5,391,069 A * 2/1995 Bendzick ..... 425/78
5,498,147 A * 3/1996 Katagiri et al. ..... 425/78
5,547,360 A * 8/1996 Yokoyama ..... 425/149
5,566,373 A * 10/1996 Seimetz et al. ..... 419/66
5,906,837 A * 5/1999 Link et al. ..... 425/78
5,989,487 A * 11/1999 Yoo et al. ..... 266/249
6,004,120 A * 12/1999 Matsubara et al. ..... 425/78
6,383,447 B1 * 5/2002 Nakata et al. ..... 419/66
6,402,493 B1 * 6/2002 Matsubara et al. ..... 425/78
6,403,025 B2 * 6/2002 Goransson ..... 419/38
6,477,945 B1 * 11/2002 Imanishi et al. ..... 100/264
6,531,090 B2 * 3/2003 Ogawa ..... 419/38

FOREIGN PATENT DOCUMENTS

DE 42 09 767 C1 5/1993
DE 197 17 217 C2 12/1999
DE 199 58 999 A1 4/2001

* cited by examiner

PROCESS FOR THE MANUFACTURE OF COMPACTS IN A POWDER PRESS

CROSS-REFERENCE TO RELATED APPLICATIONS

Not Applicable.

Statement Regarding Federally Sponsored Research

Not Applicable.

BACKGROUND OF THE INVENTION

It is known to manufacture blanks from cemented carbide, ceramic material, sintered metal or the like by means of presses. The powdered or granular material requires to be provided in such a manner that the compact, when under an applied compacting pressure, is given a homogeneous structure and allows itself to be sintered. A common forming operation is the so-called direct pressing process in appropriately designed die-sets or die-plates with which a top ram and a bottom ram are associated. In accordance with the respective compacting pressure, different densities will result for the compact. Lower-density compacts, however, while being sintered will shrink more than higher-density compacts do. An attempt is made to minimize variations in density by means of differently adjustable compression strokes for the top and bottom rams. On the other hand, in practice, varying densities may arise because of varying compressive forces which, in turn, are provoked, for example, by charging variations which may amount to some per cents with the compact heights being the same. A difficulty in manufacturing compacts, e.g. for cemented-carbide reversible cutting blades, is that a predetermined overall height is maintained between the cutting blade receptacle and at least one cutting edge which is of a predetermined distance from the cutting blade receptacle.

It has become known from DE 42 09 787 to measure the compressive force with a view to achieving a density as uniform as possible within a batch. A correction is made subsequently, which depends on the compressive force measured, via the charging volume for the compacts that succeed.

Further, it has become known from DE 197 17 217 to determine and store a desired force-stroke diagram (a desired curve), which is dependent on the geometry of the compact and the base material, for a compacting ram during compression. During compression, the values measured for the stroke and force of the compacting ram are compared to the desired curve in a computer. Using at least one separately operated portion of the compacting ram or a separate ram, the pressure acting on the material to be compacted is increased or decreased during the compression phase as soon as a deviation from the desired curve is determined to exist with a view to obtaining the same density for each compact at the end of the compression phase. This process requires that at least two position sensors be provided, i.e. for the at least one compacting ram and the at least one further compacting ram or portion of the compacting ram which provide their measuring values each to a control computer. In addition, the compacting ram or a portion of the compacting ram has associated therewith a force sensor. Its values are also input to the control computer. The position sensors are intended to ensure that if there are an upper ram and a lower ram those move to a predetermined position in the die-plate to produce the predetermined geometry of the compact and to maintain its dimensions. However, since the filling level is different variations in density might occur, which have to be avoided. This is why the further compacting ram is provided, which is actuated by the control computer when a deviation from the desired density value is determined during the respective compacting process. This process is based on the assumption that a more or less pronounced deformation may be accepted on a surface of the compact, which is required to achieve the desired density. This is the case, for instance, for reversible cutting blades on the receptacle surface.

It is understood that a procedure of this type cannot be applied to compacts if a predetermined outer contour has to be observed for the compact.

As was mentioned previously it is significant to keep to a predetermined density of a compact because its density will determine shrinkage during sintering afterwards. Naturally, density may only be determined indirectly via the compressive force applied to the material, which is known as such. Consider here that the compressive force or maximal compressive force is not to be seen completely identical to a predetermined density because the material of the compact springs back depending on its nature after a load relief so that its density will change. Such change may possibly have undesirable effects. If a certain geometry is maintained for the compact differing values of compressive forces will result in response to the filling volume, but also in response to the homogeneity of the powder in the compact.

Compacts having irregular outer contours, e.g. for reversible cutting blades including grooves or chip guide surfaces or the like on the upper surface, will exhibit differing density distributions also during the compressing operation. However, since the position and run of the cutting edge and the topography associated therewith are important an unequal distribution of density results in undesirable dimensional variations during sintering.

It is the object of this invention to provide a process for the manufacture of compacts, particularly for cemented-carbide cutting blades, by compressing metallic powder in powder presses wherein the manufacture of compacts results in articles of a reproducible accuracy in the sintering process.

BRIEF SUMMARY OF THE INVENTION

The invention relies on the finding that if there is a reversible cutting blade having a predetermined topography in the region of the cutting edge and the upper surface the upper region of the compact is sensitive, for example, and particular care has hence to be taken in achieving the desired density in this region. In the invention, this is accomplished by presetting the energy to be applied by the upper ram into the upper region of the compact. If this energy is substantially applied in a regular way this will also ensure the desired density and the uniform distribution of density in this region. Then, it will not be so significant whether the remaining region of the compact is compressed at exactly the same density. However, in order to obtain a density approximated to the density in the upper region also in this region a determination is made for the overall amount of energy application for the compact. Therefore, during the compressing operation, care is initially taken that the energy applied by the upper ram be reproducible. Since there is no regulation via the compression path if the filling volumes are different the energy applied is used as a basis, as was mentioned, assuming that the desired density has been reached in the upper region of the compact if the amount of energy applied has a predetermined value. In this process, the lower ram is moved up "after" the upper ram by advancing it depending on the amount of residual energy applied. What is meant by the residual energy is the energy which is left when the energy applied by the upper ram is deducted from the predetermined overall energy. It might occur that the thickness predetermined for the compact is not achieved here. For such a case, reworking is necessary on the sintered compact. However, it will possibly not be detrimental either if the energy applied by the lower ram is slightly increased to achieve the thickness set because the effect on the compaction of the upper region is negligible.

According to an aspect of the invention, a provision is made for the course of energy application to be stored via a compacting path of the upper ram and the feed rate of the upper ram is regulated depending on this course. It may also be contemplated here to split up the overall energy into a number of increments according to which a regulation of the feed motion of the upper ram will be possible.

When powdered material is compressed in which the grains of the powder "catch their claws" into and with each other the factor primarily decisive for achieving a desired thickness is the phase at which a major compacting pressure is applied already. Therefore, an aspect of the invention provides that the first and second energy application values are stored only for the second half of the compacting path of the upper ram or that the energy applied by the upper and lower rams is compared to the first and second values only during the second half of the compressing operation of the upper ram. It is understood that the regulation path at a relationship with the compression path may also be placed to be near the end of the compression path.

The energy which is applied to a compact during compression is the product of force by compression path. In reality, however, the energy actually utilized is not equal to this product, but is less because the compact springs back and, thus, some portion of compression energy is not utilized for compaction. According to an aspect of the invention, the spring-back path of the compact is measured and the non-utilized energy is calculated therefrom. This calculation may be resorted to for correction while the next compact is compressed if the application energy actually utilized does not match a predetermined value. Then, the energy applied may be varied by varying parameters during the compressing operation. This can be accomplished, for example, by varying the filling level, using different displacement paths of the charging shoe, vibrating the die-plate, lower and/or upper ram, or the like.

BRIEF DESCRIPTION OF THE SEVERAL VIEWS OF THE DRAWINGS

The invention will now be explained in more detail with reference to the drawings.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
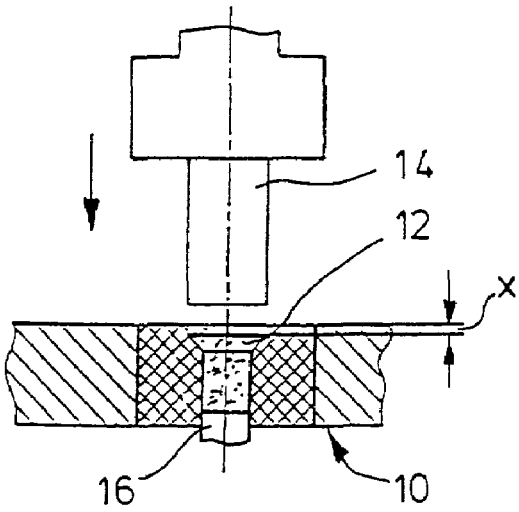
FIG. 1 shows a press to compress metallic powder according to the inventive process prior to the compressing operation proper.
Figure 2:
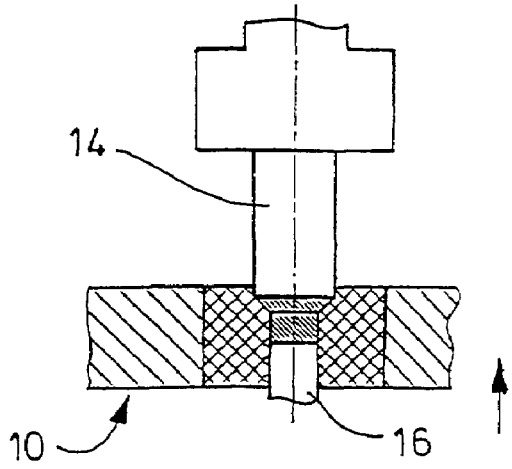
FIG. 2 shows the press of FIG. 1 during the compressing operation.
Figure 5:
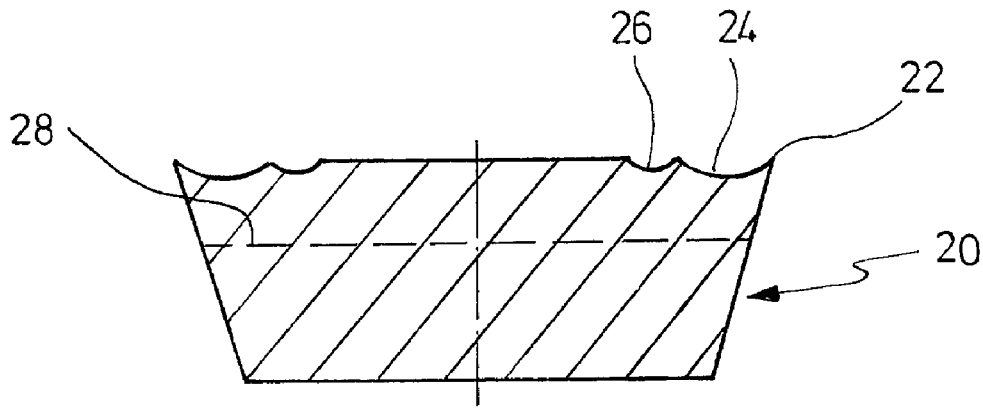
FIG. 5 shows a section through a cutting blade produced in a sintering process in a schematic representation

Referring to FIGS. 1 and 2, a die-plate 10 is shown the bore of which has a die cavity 12 which is conical in cross-section. Such a die cavity 12 makes it possible to produce a compact which is used for a cutting blade, as is shown in FIG. 5. The cutting blade of FIG. 5 has a clearance angle. The upper edge of the die cavity 12 (die-bore) is at a distance x from the upper edge of the die-plate 10. A top ram 14 is disposed above the die-plate 10 and a bottom ram 16 is outlined below the die-plate 10. The rams 14, 16 are operated in an appropriate manner, preferably using hydraulic press cylinders. These are controllable in a way (not shown) so as to apply a desired force. Moreover, they may be controlled in their speeds in order to generate a desired force-time curve, for example. Appropriate force-measuring devices which are associated with the rams 14, 16 determine the respective compression forces applied. Position pickups (not shown) determine the positions of the upper and lower rams 14, 16 during the compressing operation.

Figure 3:
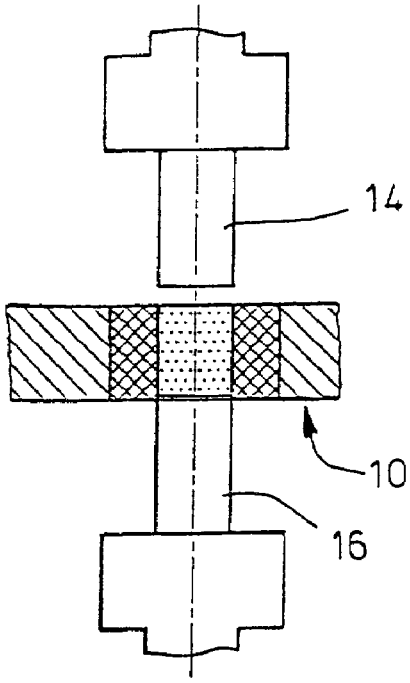
FIG. 3 shows a modified press to carry out the inventive process.
Figure 4:
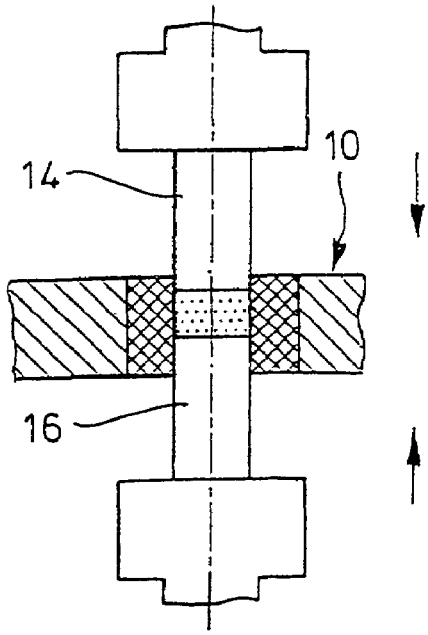
FIG. 4 shows the press of FIG. 3 during the compressing operation.

While the die-plate bore is being charged the bottom ram 16 is at a predetermined charging position. Its position will determine the charging volume. Preferably, the position initially is somewhat lower than the theoretical charging position for the predetermined volume to allow the column to run upwards through a certain length after the charging operation in order that the charging shoe (not shown) may strip excess material from the upper surface of the die-plate. Subsequently, the top ram 14 and the bottom ram 16 are caused to move into the die-plate bore with the top ram 14 moving in to such an extent that it comes to lie at the upper surface of the die cavity 12. Thus, the depth to which it moves into the die-plate bore corresponds to the measure x. The bottom ram 16 is also displaced to a predetermined position as is shown in FIG. 2. A compressing operation takes place subsequently. The embodiment of FIGS. 3 and 4 is distinguished from the one of FIGS. 1 and 2 by the fact that the die-plate bore is cylindrical. The cutting blade produced by means of the process has no clearance angle. For the rest, the embodiment of FIGS. 3 and 4 is given the same reference numbers as the one of FIGS. 1 and 2.

It can be appreciated from FIG. 5 that the cutting blade 20 has two grooves 24, 26 adjacent to the cutting edge 22. The grooves are only outlined here for representation purposes. Cutting blades of the type shown may exhibit various topographies on the upper side which are meant to improve the cutting behaviour of the plate. Cutting edges 22 frequently have no linear extension, but are curved in space in a predetermined way.

According to the invention, the upper ram 14 is intended to produce a predetermined density in the upper region of the cutting blade 20 that is limited downwardly by a phantom line 28. This requires that the energy applied by the upper ram 14 corresponds to a predetermined value once the ram has arrived at its final position. The energy or work applied corresponds to the measured compressive force multiplied by the compression path. Thus, this process does not rely on a predetermined curve for the compression force, but on achieving a constant energy application to all compacts. This includes that the compression force of the lower ram may quite be different. The compression force of the lower ram will then be "rectified" depending on the energy application effected by the upper ram. The result might be that the density existing in the lower region of sintered cutting plate 20 slightly deviates from the one in the upper region. This needs to be accepted, however, if it is sure that precise dimensions can be achieved for the upper region of cutting plate 20.

Figure 6:
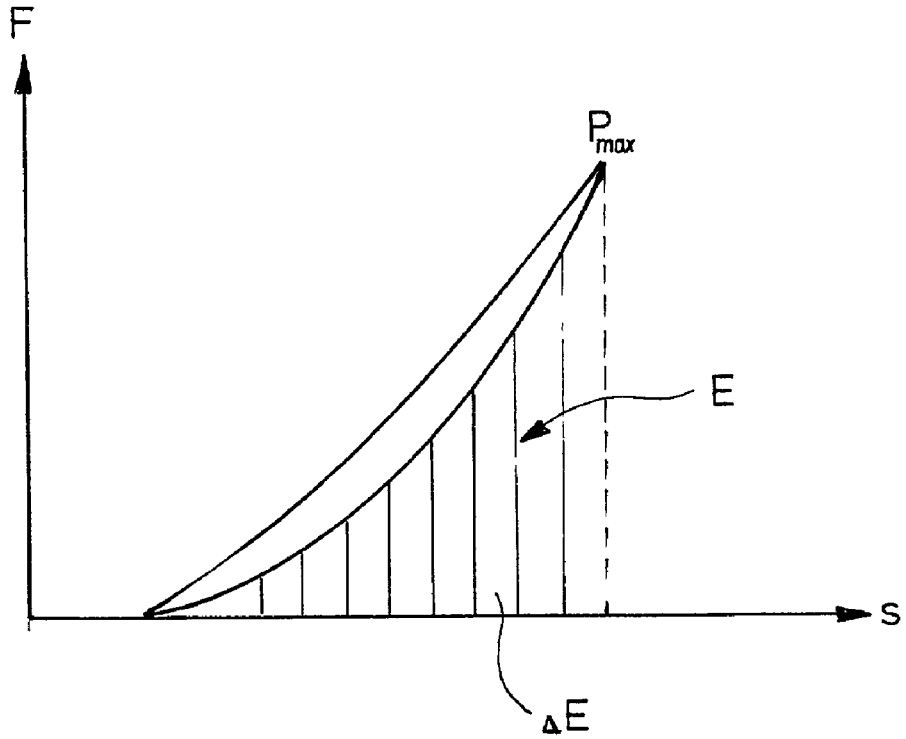
FIG. 6 shows a force-stroke diagram to illustrate the inventive process.

A force-path diagram is shown for the upper ram 14 in FIG. 6. The curve of compressive force ascends up to a maximum compression force value $P_{max}$. The integral below this curve corresponds to energy application E during the compressing operation. Energy application E is composed of individual increments ΔE and it is readily possible to control the upper ram 14 so as to apply predetermined energy increments. The energy finally used, however, is lower than the energy initially applied because the compact exhibits a spring-back behaviour. Some sort of hysteresis is formed as is shown in FIG. 6. The surface between the branches of the curve of FIG. 6 represents the energy not utilized for the compression of the compact. Hence, the predetermined density aimed at in the upper region of cutting plate 20 is determined by the energy which results from the surface below the lower course of the curve. The spring-back behaviour is measurable and the spring-back path allows to determine the non-utilized energy. The spring-back action is no more usable for a correction to the present compact while under compression, but can only be used for the compact which comes next. Varying the parameters of the compression procedure permits to influence the energy applied by the upper ram and, hence, to vary them until the desired value is reached.

The above Examples and disclosure are intended to be illustrative and not exhaustive. These examples and description will suggest many variations and alternatives to one of ordinary skill in this art. All these alternative and variations are intended to be included within the scope of the attached claims. Those familiar with the art may recognize other equivalents to the specific embodiments described herein which equivalents are also intended to be encompassed by the claims attached hereto.

What is claimed is:

1. A process for the manufacture of cutting plates comprising the steps of:

providing metal powder and a metal powder press, compacting the metal powder in the metal powder press, and sintering the compacted metal, wherein:

the metal powder defines a volume and has an upper region and a lower region;

the powder press has:

at least one upper ram positioned above the metal powder, at least one lower ram positioned below the metal powder, and a controller device, the upper ram having a non-linear pressing surface, the upper and lower rams both being actuated by a hydraulic press;

the controller device:

storing a pre-determined total amount of energy to be applied to the powder, actuating the upper ram until the upper region is compacted into a desired configuration then stopping the upper ram, determining the amount of energy expended by the upper ram, subtracting the expended energy from the pre-determined total amount of energy to be applied to define a second energy value, actuating the lower ram and then stopping the lower ram once the second energy value has been reached, the desired configuration of the upper region of the compacted metal powder having a pre-determined density and forming a non-linear cutting edge along the top of the upper region, the non-linear cutting edge comprising at least one groove, the density of the lower region being different from the density of the upper region.

2. The process of claim 1 in which the resulting cutting blade is a cemented-carbide cutting blade.

3. The process of claim 1 in which the upper region is wider than the lower region.

4. The process of claim 1 in which a portion of the resulting cutting edge is linear.

5. The process of claim 1 in which the upper ram forms at least one groove adjacent to at least one side of the cutting plate.

6. The process of claim 1 in which the upper ram forms a cutting plate with at least one curved side.

7. The process of claim 1 in which the resulting upper region has a higher density than the resulting lower region.

8. The process of claim 1 in which the energy applied by the lower ram is lower than the energy applied by the upper ram.

9. The process of claim 1 in which the cutting edge has a plurality of grooves.

* * * * *